US011793362B2

(12) United States Patent
Cotner

(10) Patent No.: US 11,793,362 B2
(45) Date of Patent: Oct. 24, 2023

(54) TOOTHPASTE AND TOOTHBRUSH HOLDER ASSEMBLY

(71) Applicant: Gary Cotner, Jerseyville, IL (US)

(72) Inventor: Gary Cotner, Jerseyville, IL (US)

( * ) Notice: Subject to any disclaimer, the term of this patent is extended or adjusted under 35 U.S.C. 154(b) by 529 days.

(21) Appl. No.: 17/094,382

(22) Filed: Nov. 10, 2020

(65) Prior Publication Data

US 2022/0142351 A1 May 12, 2022

(51) Int. Cl.

| | |
|---|---|
| ***A47K 1/09*** | (2006.01) |
| ***B65D 35/34*** | (2006.01) |
| ***A47K 5/18*** | (2006.01) |
| *A46B 17/08* | (2006.01) |

(52) U.S. Cl.

CPC ..... *A47K 1/09* (2013.01); *A47K 5/18* (2013.01); *B65D 35/34* (2013.01); *A46B 17/08* (2013.01)

(58) Field of Classification Search

CPC ..... A47K 1/09; A47K 5/18; A47K 2201/00; B65D 35/34; B65D 35/32; B65D 35/285; A45D 44/18; A47G 29/08; A47G 1/17; A46B 17/02; A46B 17/08

USPC ..... 211/65

See application file for complete search history.

(56) References Cited

U.S. PATENT DOCUMENTS 1,575,386 A * 3/1926 Bandall ..... B65D 35/34 222/93
2,183,060 A * 12/1939 Blake ..... B65D 35/285 D6/541
2,548,535 A * 4/1951 Iannone ..... A47K 5/18 222/93
2,683,555 A * 7/1954 Brandstetter ..... B65D 35/34 222/93
2,708,532 A * 5/1955 Tarbox ..... B65D 35/34 222/100
2,709,023 A * 5/1955 Royals ..... B65D 35/34 222/105
2,760,681 A * 8/1956 Arquelles ..... B65D 35/34 222/93
2,797,886 A * 7/1957 Pinckney ..... A47K 1/09 248/113
2,917,182 A * 12/1959 Browne ..... A47K 1/09 D6/534
3,138,414 A * 6/1964 La Pollo ..... A47K 1/09 312/207
3,155,279 A 11/1964 Ferguson, Jr.
3,204,824 A * 9/1965 McGraw, Jr. ..... B65D 35/34 222/100

(Continued)

FOREIGN PATENT DOCUMENTS

KR 200900126 2/2009

*Primary Examiner* — Hiwot E Tefera

(57) ABSTRACT

A toothpaste and toothbrush holder assembly for storing a toothpaste tube and a pair of toothbrushes includes a base that can be positioned on a support surface. A mating unit is integrated into the base to engage the support surface thereby inhibiting the base from moving on the support surface. A stand is removably attachable to the base and the stand has a pair of supports each is integrated therein to store a toothbrush. A cylinder is provided that has a channel extending therethrough for having a closed end of a toothpaste tube inserted therein. A shaft is rotatably integrated into the cylinder to receive the closed end of the toothpaste tube. A knob is coupled to the shaft and the knob can be gripped by a user for rolling the toothpaste tube around the shaft.

13 Claims, 5 Drawing Sheets

(56) References Cited

U.S. PATENT DOCUMENTS

| | | | | | |
|---|---|---|---|---|---|
| 3,920,157 | A * | 11/1975 | Yeung | B65D 35/34 | 222/100 |
| 4,010,871 | A * | 3/1977 | Broadie | B65D 35/34 | 222/93 |
| 4,979,708 | A * | 12/1990 | Aoki | A47K 1/09 | 248/110 |
| 5,097,987 | A * | 3/1992 | Liberatore | B65D 35/32 | 248/108 |
| 5,449,092 | A * | 9/1995 | Bazan | B65D 35/34 | 222/93 |
| 5,642,839 | A * | 7/1997 | Lee | B65D 35/34 | 222/99 |
| 5,884,812 | A * | 3/1999 | Stawowski | B65D 35/32 | 222/100 |
| 6,402,104 | B1 * | 6/2002 | Smith | A47K 1/09 | 248/205.8 |
| 8,371,549 | B1 | 3/2013 | Paquette | | |
| 10,058,219 | B2 | 8/2018 | Collins | | |
| 2004/0050733 | A1 * | 3/2004 | Page | A47K 1/09 | 206/362.2 |
| 2005/0109662 | A1 * | 5/2005 | Kirk | A47K 1/09 | 206/581 |
| 2007/0158518 | A1 * | 7/2007 | Kurdoghlian | A47K 1/09 | 248/312 |
| 2013/0015201 | A1 * | 1/2013 | Lohmann | A46B 15/0055 | 222/78 |
| 2013/0230349 | A1 | 9/2013 | Dontfraid | | |

* cited by examiner

TOOTHPASTE AND TOOTHBRUSH HOLDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to holder devices and more particularly pertains to a new holder device for storing a toothpaste tube and a pair of toothbrushes.

(2) Description of Related Art Including Information Disclosed Under 37 CFR 1.97 and 1.98

The prior art relates to holder devices including a variety of devices that include at least one recess in which a toothbrush can be suspended for storage and a dispensing nozzle for engaging a toothpaste tube. In no instance does the prior art disclose a toothbrush holder which includes a rolling mechanism for rolling up a toothpaste tube to squeeze the entire contents out of the toothpaste tube.

BRIEF SUMMARY OF THE INVENTION

An embodiment of the disclosure meets the needs presented above by generally comprising a base that can be positioned on a support surface. A mating unit is integrated into the base to engage the support surface thereby inhibiting the base from moving on the support surface. A stand is removably attachable to the base and the stand has a pair of supports each is integrated therein to store a toothbrush. A cylinder is provided that has a channel extending therethrough for having a closed end of a toothpaste tube inserted therein. A shaft is rotatably integrated into the cylinder to receive the closed end of the toothpaste tube. A knob is coupled to the shaft and the knob can be gripped by a user for rolling the toothpaste tube around the shaft.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
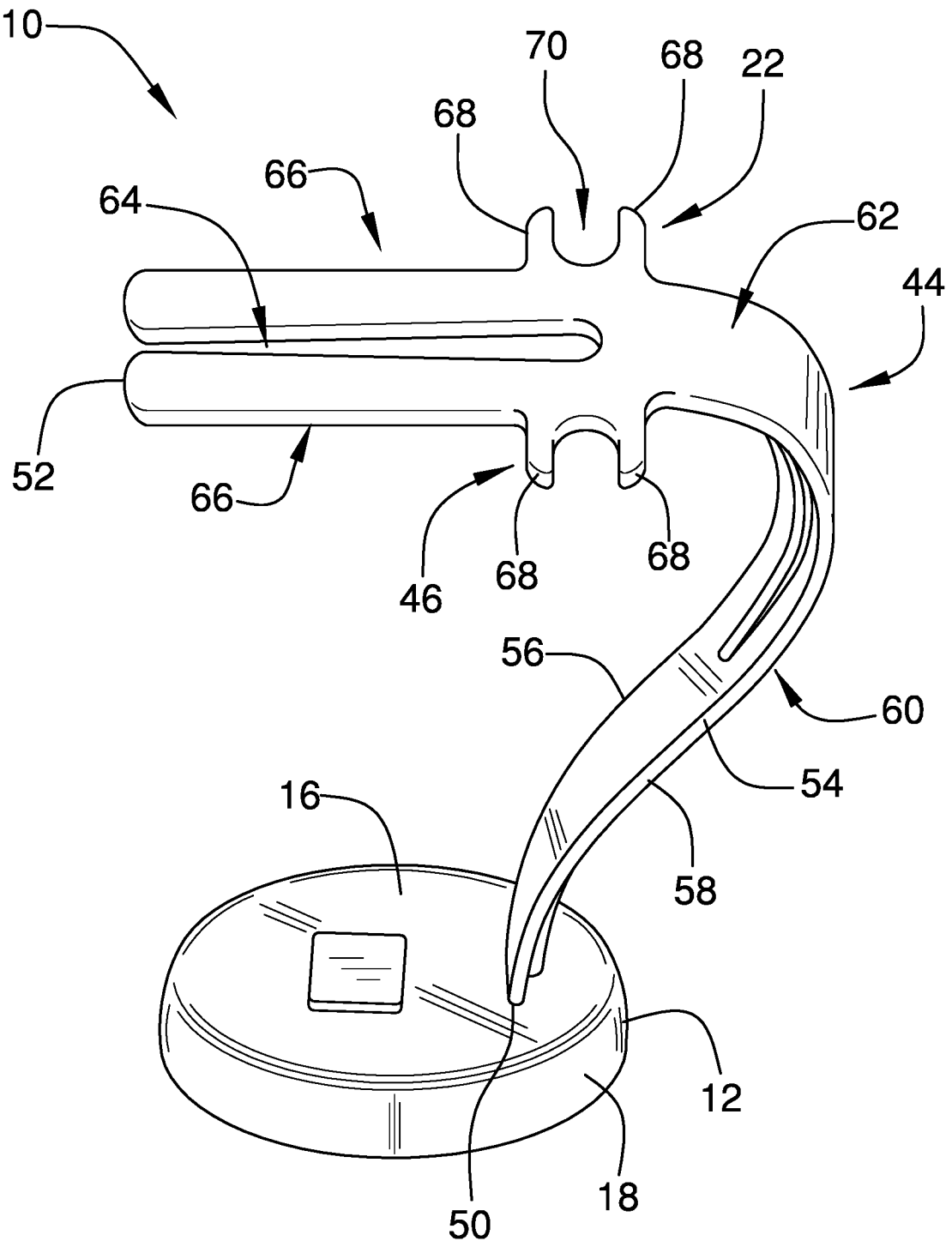
FIG. 1 is a top perspective view of a toothpaste and toothbrush holder assembly according to an embodiment of the disclosure.
Figure 2:
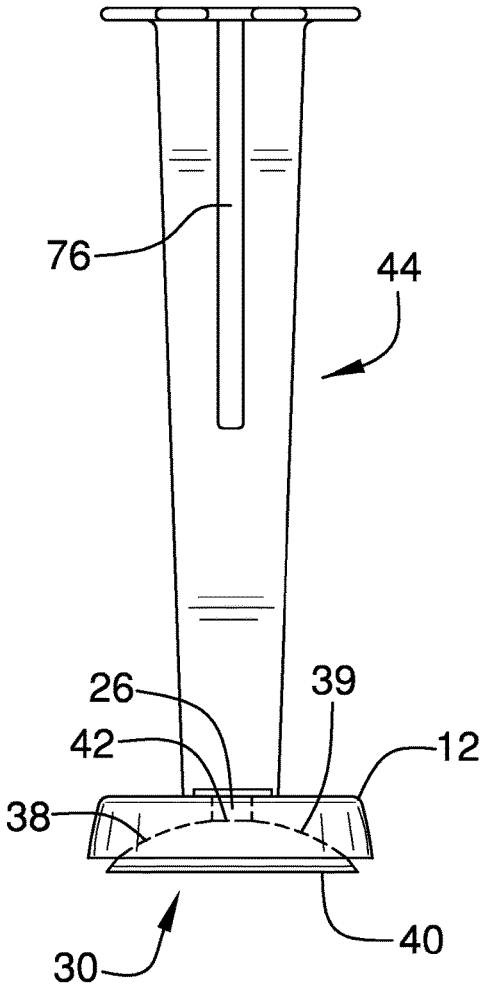
FIG. 2 is a front phantom view of an embodiment of the disclosure.
Figure 3:
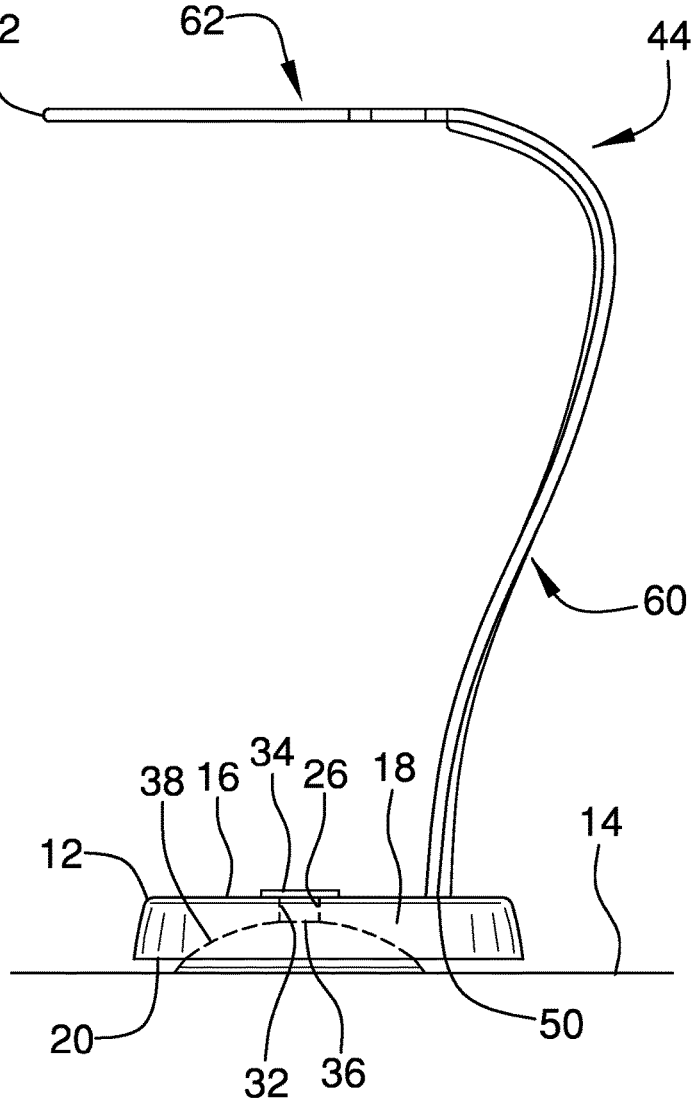
FIG. 3 is a left side phantom view of an embodiment of the disclosure.
Figure 4:
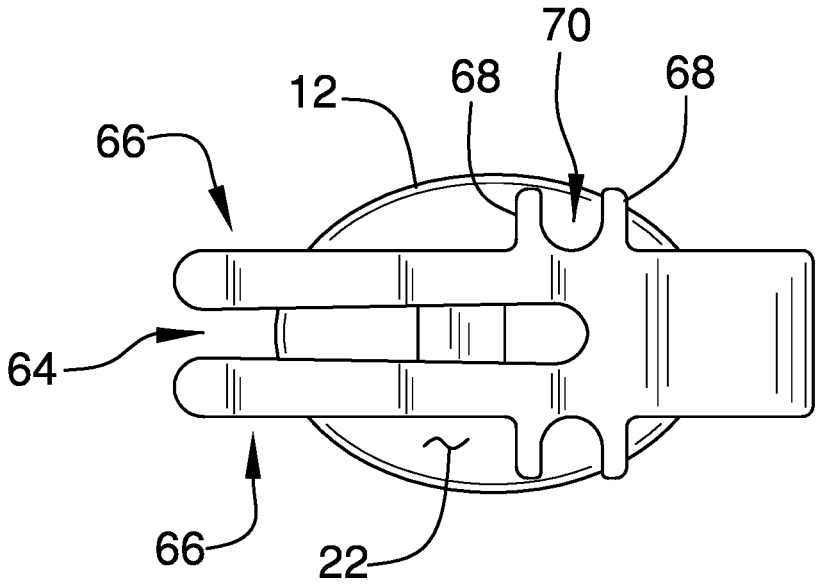
FIG. 4 is a top view of an embodiment of the disclosure.
Figure 5:
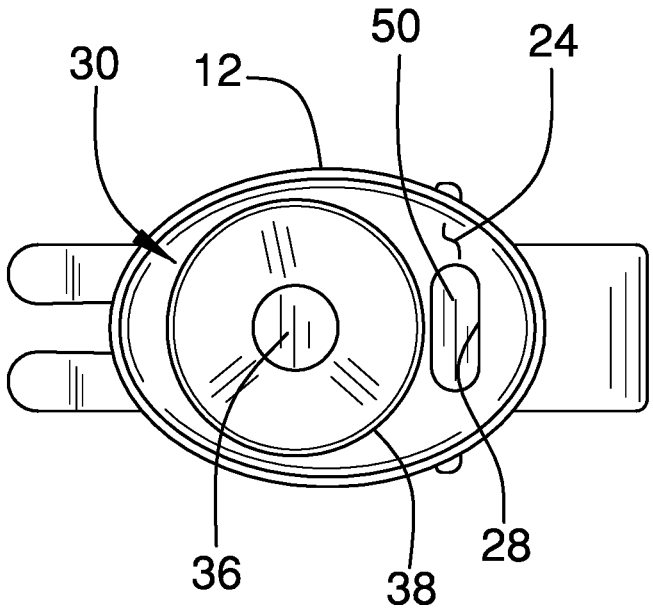
FIG. 5 is a bottom view of an embodiment of the disclosure.
Figure 6:
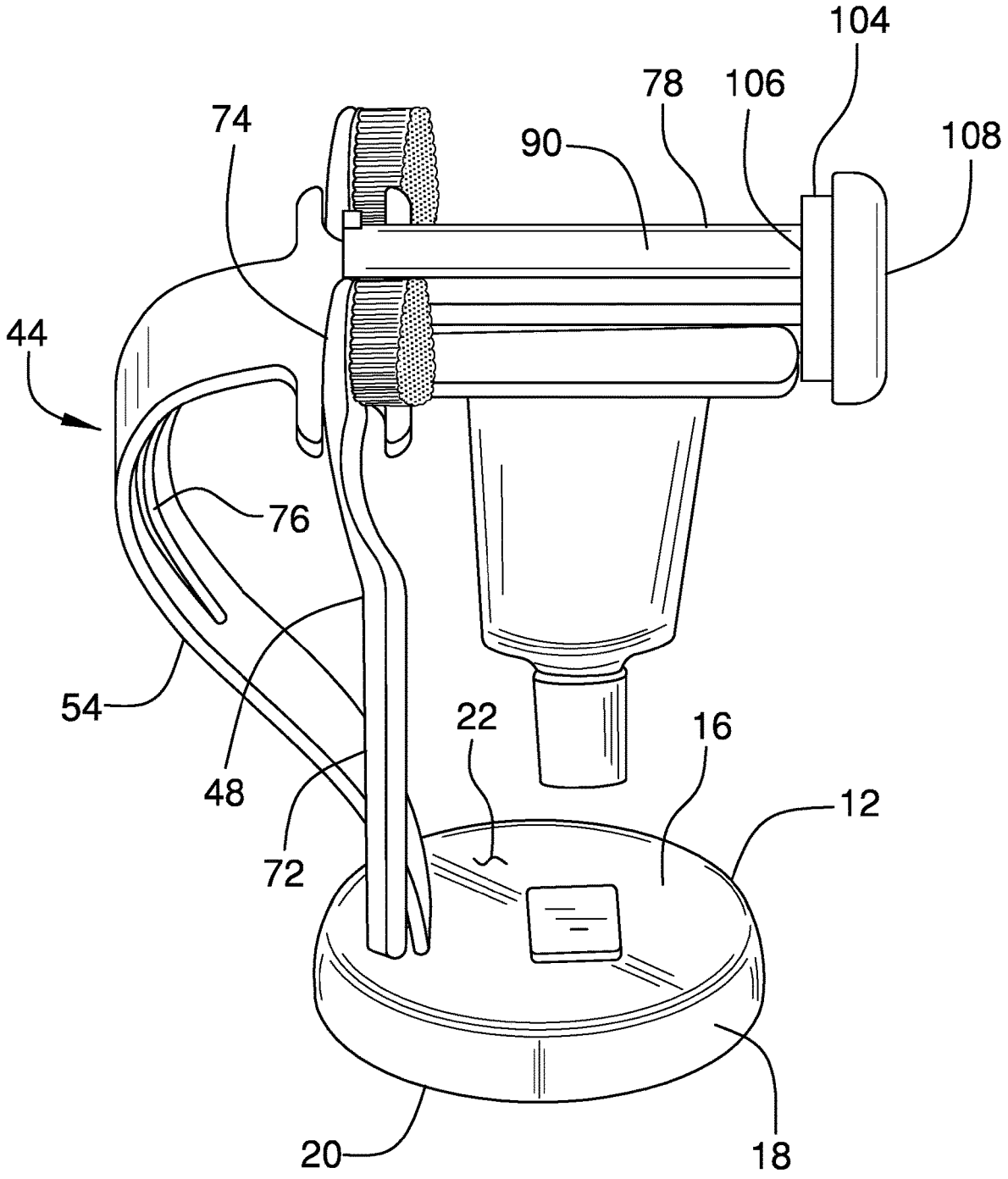
FIG. 6 is a perspective in-use view of an embodiment of the disclosure.
Figure 8:
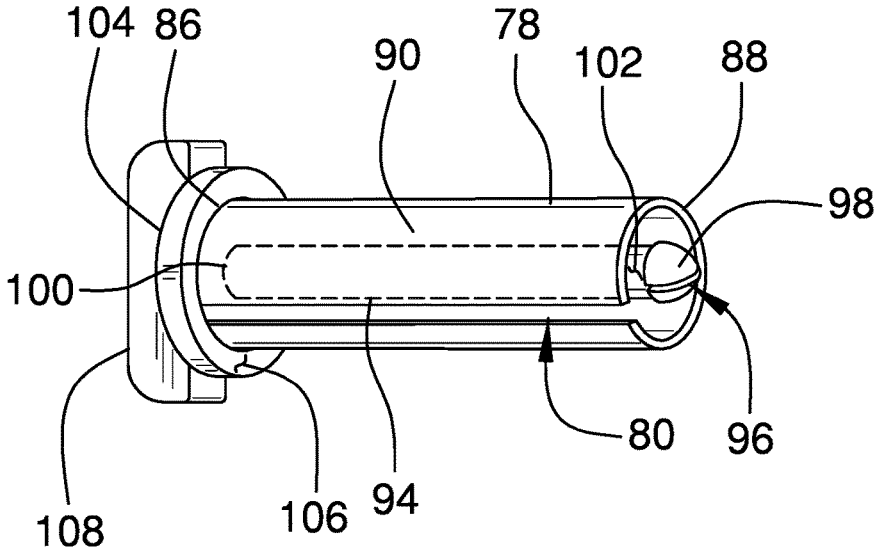
FIG. 8 is a perspective phantom view of a cylinder and a shaft of an embodiment of the disclosure.
Figure 7:
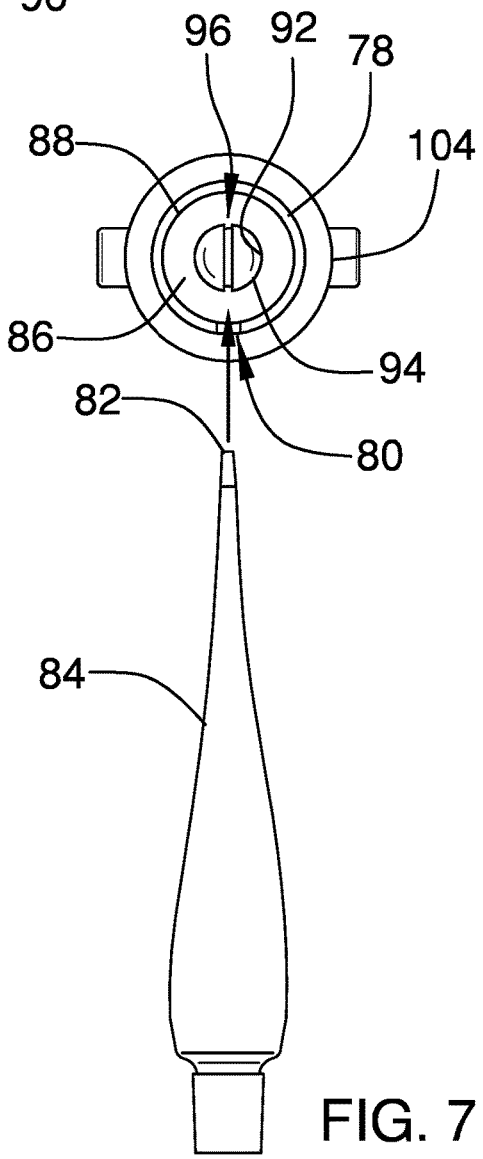
FIG. 7 is a front view of a cylinder and a shaft of an embodiment of the disclosure.

With reference now to the drawings, and in particular to FIGS. 1 through 8 thereof, a new holder device embodying the principles and concepts of an embodiment of the disclosure and generally designated by the reference numeral 10 will be described.

As best illustrated in FIGS. 1 through 8, the toothpaste and toothbrush holder assembly 10 generally comprises a base 12 that can be positioned on a support surface 14, such as a counter top in a bathroom or other horizontal surface. The base 12 has a top wall 16 and a perimeter wall 18 extending downwardly therefrom and the perimeter wall 18 is continuously arcuate about a center point of the top wall 16. The top wall 16 is elongated along a central axis such that the base 12 has an oval shape, and the perimeter wall 18 has a distal edge 20 with respect to the top wall 16.

The top wall 16 has a top surface 22 and a bottom surface 24, and the top wall 16 has an opening 26 extending though the top surface 22 and the bottom surface 24. The opening 26 is aligned with the central axis and the opening 26 is offset from the center point of the top wall 16. Additionally, the top wall 16 has a hole 28 extending through the top surface 22 and the bottom surface 24, and the hole 28 is positioned between the opening 26 and the perimeter wall 18. Moreover, the hole 28 is aligned with the central axis and the hole 28 is elongated along an axis that is oriented perpendicular to the central axis.

A mating unit 30 is integrated into the base 12 to engage the support surface 14 thereby inhibiting the base 12 from moving on the support surface 14. The mating unit 30 comprises a stem 32 that has a head 34 and a distal end 36. The stem 32 extends through the opening 26 in the top wall 16 of the base 12 having the head 34 resting on the top wall 16. Moreover, the head 34 has dimensions that are greater than dimensions of the opening 26 such that the head 34 inhibits the stem 32 from passing fully through the opening 26.

The mating unit 30 includes a cup 38 that has top wall 39 a bottom edge 40, and the top wall 16 is concavely arcuate with respective to the bottom edge 40. The distal end 36 of the stem 32 is coupled to an apex 42 of the top wall 39 of the cup 38 such that the bottom edge 40 can be compressed against the support surface 14. Moreover, the cup 38 is comprised of a resiliently deformable material thereby facilitating the cup 38 to suctionally engage the support surface 14 when the cup 38 is compressed thereupon.

A stand 44 is removably attachable to the base 12 and a pair of supports 46 is each integrated therein. Each of the supports 46 is spaced above the base 12 when the stand 44 is attached to the base 12 and each of the supports 46 can store a toothbrush 48. The stand 44 has a first end 50, a second end 52 and an outer edge 54 extending therebetween, the outer edge 54 has a first lateral side 56 and a second lateral side 58 and the stand 44 is widened between the first lateral side 56 and the second lateral side 58. The stand 44 has a first portion 60 and a second portion 62; the first end 50 is associated with the first portion 60 and the second end 52 is associated with the second portion 62. The first portion 60 undulates betweens the first end 50 and the second portion 62 such that the stand 44 approximates a question mark shape.

The second portion 62 is spaced from the top surface 22 of the top wall 16 and extends along a horizontal axis when the first end 50 is inserted into the hole 28 in the top wall 16. The second portion 62 has a slot 64 extending from the second end 52 toward the first portion 60 to define a pair of fingers 66 that are spaced apart from each other and are coextensive with each other. Each of the supports 46 comprises a pair of peninsulas 68 which each extends laterally away from a respective one of the first lateral side 56 and the second lateral side 58 of the outer edge 54 of the stand 44. Additionally, each of the peninsulas 68 is positioned on a respective one of fingers 66. The peninsulas 68 are spaced apart from each other to define a toothbrush space 70 that can receive a handle 72 of a respective toothbrush 48 having a head 74 of the respective toothbrush 48 resting on the peninsulas 68. The first lateral side 56 and the second lateral side 58 of the outer edge 54 associated with each of the fingers 66 is concavely arcuate between each of the peninsulas 68 of a respective one of the supports 46. As is most clearly shown in FIG. 2, a gusset 76 may be integrated into the stand 44 that extends along the curvature between the first portion 60 and the second portion 62 of the stand 44 for reinforcing the stand 44.

A cylinder 78 is provided that has a channel 80 extending therethrough such that the channel 80 can have a closed end 82 of a toothpaste tube 84 inserted therein. The cylinder 78 has a closed end 86, an open end 88 and an outer wall 90 extending therebetween. The channel 80 extends through the outer wall 90 and the channel 80 extends from the open end 88 toward the closed end 86. The closed end 86 has an aperture 92 extending therethrough and the aperture 92 is centrally positioned on the closed end 86. Moreover, the cylinder 78 is positionable in the slot 64 in the second portion 62 of the stand 44 having the cylinder 78 resting on the fingers 66 for storing the cylinder 78. In this way the cylinder 78 facilitates the toothpaste tube 84 to extend downwardly through the slot 64 in the second portion 62 of the stand 44 during storage.

A shaft 94 is provided and the shaft 94 is rotatably integrated into the cylinder 78. The shaft 94 has a slot 96 integrated therein to receive the closed end 86 of the toothpaste tube 84. The shaft 94 has a primary end 98, a secondary end 100 and an outer surface 102 extending therebetween, and the shaft 94 is elongated between the primary end 98 and the secondary end 100. The slot 64 extends fully through the outer surface 102 of the shaft 94, and the slot 64 extends from the primary end 98 toward the secondary end 100. The shaft 94 extends through the aperture 92 in the closed end 86 of the cylinder 78 having the primary end 98 being exposed in the open end 88 of the cylinder 78.

A knob 104 is coupled to the shaft 94 such that the knob 104 can be gripped by a user for rolling the toothpaste tube 84 around the shaft 94. The knob 104 has a first surface 106 and the secondary end 100 of the shaft 94 is coupled to the first surface 106. Thus, the knob 104 is positioned against the closed end 86 of the cylinder 78. The knob 104 might include a grip 108 that is integrated therein for enhancing gripping the knob 104 to rotate the knob 104.

In use, the closed end 86 of the toothpaste tube 84 is inserted through the channel 80 in the cylinder 78 and into the slot 96 in the shaft 94. In this way the toothpaste tube 84 is rolled around the shaft 94 when the knob 104 is rotated thereby facilitating the entire contents of the toothpaste tube 84 to be squeezed out. The cylinder 78 is rested on the fingers 66 for storage having the toothpaste tube 84 extending through the slot 64 between the fingers 66. Additionally, a pair of toothbrushes 48 can each be suspended on a respective support 46 for storing the toothbrushes 48. In this way the toothbrushes 48 and the toothpaste tube 84 can be stored in a hygienic and convenient manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toothpaste and toothbrush holder assembly for rolling up a tube of toothpaste and holding toothbrushes when not in use, said assembly, comprising:

a base being configured to be positioned on a support surface;

a mating unit being integrated into said base wherein said mating unit is configured to engage the support surface thereby inhibiting said base from moving on the support surface;

a stand being removably attachable to said base, said stand having a pair of supports each being integrated therein, each of said supports being spaced above said base when said stand is attached to said base wherein each of said supports is configured to store a toothbrush;

a cylinder having a channel extending therethrough wherein said channel is configured to have a closed end of a toothpaste tube inserted therein;

a shaft being rotatably integrated into said cylinder, said shaft having a slot being integrated therein wherein slot in said shaft is configured to receive the closed end of the toothpaste tube;

a knob being coupled to said shaft wherein said knob is configured to be gripped by a user for rolling the toothpaste tube around said shaft; and wherein said base has a top wall and a perimeter wall extending downwardly therefrom, said perimeter wall being continuously arcuate about a center point of said top wall, said top wall being elongated along a central axis such that said base has an oval shape, said perimeter wall having a distal edge with respect to said top wall, said top wall having a top surface and a bottom surface.

2. The assembly according to claim 1, wherein said top wall has an opening extending through said top surface and said bottom surface, said opening being aligned with said central axis, said opening being offset from said center point of said top wall.

3. The assembly according to claim 2, wherein said top wall has a hole extending through said top surface and said bottom surface, said hole being positioned between said opening and said perimeter wall, said hole being aligned with said central axis, said hole being elongated along an axis being oriented perpendicular to said central axis.

4. The assembly according to claim 2, wherein said mating unit comprises a stem having a head and a distal end, said stem extending through said opening in said top wall of said base having said head resting on said top wall, said head having dimensions being greater than dimensions of said opening such that said head inhibits said stem from passing fully through said opening.

5. The assembly according to claim 4, wherein said mating unit includes a cup having top wall a bottom edge, said top wall being concavely arcuate with respective to said bottom edge, said distal end of said stem being coupled to an apex of said top wall wherein said bottom edge is configured to be compressed against the support surface, said cup being comprised of a resiliently deformable material wherein said cup is configured to suctionally engage the support surface when said cup is compressed thereupon.

6. The assembly according to claim 3, wherein said stand has a first end, a second end and an outer edge extending therebetween, said outer edge having a first lateral side and a second lateral side, said stand being widened between said first lateral side and said second lateral side, said stand having a first portion and a second portion, said first portion having said first end being associated therewith, said second portion having said second end being associated therewith, said first portion undulating between said first end and said second portion such that said stand approximates a question mark shape, said second portion being spaced from said top surface of said top wall and extending along a horizontal axis when said first end is inserted into said hole in said top wall.

7. The assembly according to claim 6, wherein said second portion has a slot extending from said second end toward said first portion to define a pair of fingers being spaced apart from each other and being coextensive with each other.

8. The assembly according to claim 7, wherein each of said supports comprises a pair of peninsulas each extending laterally away from a respective one of said first lateral side and said second lateral side of said outer edge of said stand, each of said peninsulas being positioned on a respective one of said fingers, said peninsulas being spaced apart from each other to define a toothbrush space wherein said toothbrush space is configured to receive a handle of a respective toothbrush having a head of the respective toothbrush resting on said peninsulas, an outwardly facing edge of each of said fingers being concavely arcuate between each of said peninsulas of a respective one of said supports.

9. The assembly according to claim 1, wherein said cylinder has a closed end, an open end and an outer wall extending therebetween, said channel extending through said outer wall, said channel extending from said open end toward said closed end, said closed end having an aperture extending therethrough, said aperture being centrally positioned on said closed end.

10. The assembly according to claim 7, wherein said cylinder is positionable in said slot in said second portion of said stand having said cylinder resting on said fingers for storing said cylinder wherein said cylinder is configured to facilitate the toothpaste tube to extend downwardly through said slot in said second portion of said stand.

11. The assembly according to claim 9, wherein said shaft has a primary end, a secondary end and an outer surface extending therebetween, said shaft being elongated between said primary end and said secondary end, said slot extending fully through said outer surface of said shaft, said slot extending from said primary end toward said secondary end, said shaft extending through said aperture in said closed end of said cylinder having said primary end being exposed in said open end of said cylinder.

12. The assembly according to claim 11, wherein said knob has a first surface, said first surface having said secondary end of said shaft being coupled thereto such that said knob is positioned against said closed end of said cylinder.

13. A toothpaste and toothbrush holder assembly for rolling up a tube of toothpaste and holding toothbrushes when not in use, said assembly comprising:

a base being configured to be positioned on a support surface, said base having a top wall and a perimeter wall extending downwardly therefrom, said perimeter wall being continuously arcuate about a center point of said top wall, said top wall being elongated along a central axis such that said base has an oval shape, said perimeter wall having a distal edge with respect to said top wall, said top wall having a top surface and a bottom surface, said top wall having an opening extending through said top surface and said bottom surface, said opening being aligned with said central axis, said opening being offset from said center point of said top wall, said top wall having a hole extending through said top surface and said bottom surface, said hole being positioned between said opening and said perimeter wall, said hole being aligned with said central axis, said hole being elongated along an axis being oriented perpendicular to said central axis;

a mating unit being integrated into said base wherein said mating unit is configured to engage the support surface thereby inhibiting said base from moving on the support surface, said mating unit comprising:

a stem having a head and a distal end, said stem extending through said opening in said top wall of said base having said head resting on said top wall, said head having dimensions being greater than dimensions of said opening such that said head inhibits said stem from passing fully through said opening; and a cup having top wall a bottom edge, said top wall being concavely arcuate with respective to said bottom edge, said distal end of said stem being coupled to an apex of said top wall wherein said bottom edge is configured to be compressed against the support surface, said cup being comprised of a resiliently deformable material wherein said cup is configured to suctionally engage the support surface when said cup is compressed thereupon;

a stand being removably attachable to said base, said stand having a pair of supports each being integrated therein, each of said supports being spaced above said base when said stand is attached to said base wherein each of said supports is configured to store a toothbrush, said stand having a first end, a second end and an outer edge extending therebetween, said outer edge having a first lateral side and a second lateral side, said stand being widened between said first lateral side and said second lateral side, said stand having a first portion and a second portion, said first portion having said first end being associated therewith, said second portion having said second end being associated therewith, said first portion undulating between said first end and said second portion such that said stand approximates a question mark shape, said second portion being spaced from said top surface of said top wall and extending along a horizontal axis when said first end is inserted into said hole in said top wall, said second portion having a slot extending from said second end toward said first portion to define a pair of fingers being spaced apart from each other and being coextensive with each other, each of said supports comprising a pair of peninsulas each extending laterally away from a respective one of said first lateral side and said second lateral side of said outer edge of said stand, each of said peninsulas being positioned on a respective one of said fingers, said peninsulas being spaced apart from each other to define a toothbrush space wherein said toothbrush space is configured to receive a handle of a respective toothbrush having a head of the respective toothbrush resting on said peninsulas, an outwardly facing edge of each of said fingers being concavely arcuate between each of said peninsulas of a respective one of said supports; and a cylinder having a channel extending therethrough wherein said channel is configured to have a closed end of a toothpaste tube inserted therein, said cylinder having a closed end, an open end and an outer wall extending therebetween, said channel extending through said outer wall, said channel extending from said open end toward said closed end, said closed end having an aperture extending therethrough, said aperture being centrally positioned on said closed end, said cylinder being positionable in said slot in said second portion of said stand having said cylinder resting on said fingers for storing said cylinder wherein said cylinder is configured to facilitate the toothpaste tube to extend downwardly through said slot in said second portion of said stand;

a shaft being rotatably integrated into said cylinder, said shaft having a slot being integrated therein wherein slot in said shaft is configured to receive the closed end of the toothpaste tube, said shaft having a primary end, a secondary end and an outer surface extending therebetween, said shaft being elongated between said primary end and said secondary end, said slot extending fully through said outer surface of said shaft, said slot extending from said primary end toward said secondary end, said shaft extending through said aperture in said closed end of said cylinder having said primary end being exposed in said open end of said cylinder; and a knob being coupled to said shaft wherein said knob is configured to be gripped by a user for rolling the toothpaste tube around said shaft, said knob having a first surface, said first surface having said secondary end of said shaft being coupled thereto such that said knob is positioned against said closed end of said cylinder.

* * * * *